US006485015B2

(12) United States Patent
Yen et al.

(10) Patent No.: US 6,485,015 B2
(45) Date of Patent: Nov. 26, 2002

(54) AUTOMATIC PAPER FEEDING SYSTEM

(75) Inventors: Wei-Feng Yen, Taipei (TW); Kun-Yee Yang, Taipei Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/789,805

(22) Filed: Feb. 22, 2001

(65) Prior Publication Data

US 2001/0019192 A1 Sep. 6, 2001

(30) Foreign Application Priority Data

Mar. 3, 2000 (TW) ..... 089103741

(51) Int. Cl.[7] ..... B65H 3/52
(52) U.S. Cl. ..... 271/121; 271/127
(58) Field of Search ..... 271/118, 121, 271/124, 126, 127, 245

(56) References Cited

U.S. PATENT DOCUMENTS 4,060,233 A 11/1977 Stange et al.
5,244,191 A * 9/1993 Kanekura ..... 271/118
5,253,854 A * 10/1993 Tanoue et al. ..... 271/121
5,358,230 A * 10/1994 Ikemori et al. ..... 271/118
5,386,983 A * 2/1995 Ando ..... 271/118
5,655,762 A * 8/1997 Yergenson ..... 271/121
5,725,208 A * 3/1998 Miyauchi ..... 271/121
5,863,036 A * 1/1999 Tanaka et al. ..... 271/121
6,059,281 A * 5/2000 Nakamura et al. ..... 271/121
6,217,017 B1 * 4/2001 Yamazaki ..... 271/121

FOREIGN PATENT DOCUMENTS

JP 404333433 * 11/1992 ..... 271/118

* cited by examiner

*Primary Examiner*—H. Grant Skaggs
(74) *Attorney, Agent, or Firm*—Winston Hsu

(57) ABSTRACT

A paper feeding mechanism with a separator and paper blocking mechanisms. When feeding paper, a lift plate carrying paper is moved up to allow a pick-up roller and the separator to move one sheet from the lift plate. After feeding paper, the lift plate is lowered away from the pick-up roller, and the paper blocking mechanism pushes excess paper back to the lift plate.

17 Claims, 6 Drawing Sheets

AUTOMATIC PAPER FEEDING SYSTEM

BACKGROUND OF THE INVENTION

1. Field of the Invention

The present invention relates to a paper feeding system and, in particular, to a paper feeding system with a separator and paper blocking mechanisms.

2. Description of the Prior Art

Business machines are often used in offices to help with the manipulation of documents. These business machines include copiers, fax machines, printers, etc. To facilitate a continuous document process, these business machines all have paper feeding systems to supply paper. Since any business machine can only process one page at a time, the paper feeding system has to be able to send exactly one sheet of paper each time. If the paper feeding system sends out more than one sheet of paper at a time, the sheets are likely to become jammed within the machine, causing delays in the whole printing process, as well as wasting paper. Therefore, it is of great importance to design a paper feeding system that can send out precisely one sheet of paper at a time.

Please refer to FIG. 1, which is a schematic view of a conventional paper feeding system 10. This paper feeding system 10 comprises a paper tray 12, a lift plate 14 rotatably fixed in the paper tray 12, a lift rod 16, and a pick-up roller 18. When the lift rod 16 rotates counterclockwise, the front end of the lift plate 14 will be lifted up so that the pick-up roller 18 contacts the uppermost paper on the lift plate 14 and pushes the paper out of the paper feeding system 10.

Please refer to FIG. 2, which shows the situation when the conventional paper feeding system 10 sends out multiple sheets of paper 11. Since the conventional paper feeding system 10 uses only the pick-up roller 18 to push the paper 11, it is likely that several sheets of paper 11 will be sent out of the paper feeding system 10 at one time because of friction between the sheets of paper. Such multiple paper feedings cause jamming in the machine. This not only wastes paper 11, but can also reduce the lifetime of the machine.

SUMMARY OF THE INVENTION

Therefore, it is a primary object of the present invention to provide a paper feeding system with separator and paper blocking mechanisms to solve the above-mentioned problems.

The present invention provides a paper feeding system with a separator and a paper blocking mechanism. The paper feeding system has a housing, and a lift plate installed in the housing for holding paper. The lift plate includes a front end and a rear end, and the rear end is rotatably fixed in the housing. A first elastic device is located under and contacts the front end of the lift plate, and is used to lift up the front end of the lift plate. A pick-up roller is rotatably fixed in the housing above the front end of the lift plate. When the first elastic device lifts up the lift plate, a sheet of paper carried by the lift plate will come into contact with the pick-up roller, and the pick-up roller frictionally engages and moves the uppermost sheet of paper out of the lift plate into a paper feeding path. A depressive device in the housing presses down on the front end of the lift plate. A separator in the housing elastically contacts the lower side of the pick-up roller. A paper blocking mechanism is rotatably fixed in the housing. The paper blocking mechanism is installed ahead of the front end of the lift plate and capable of blocking the paper, preventing the paper from moving forwards and leaving the lift plate. Finally, a driving device drives the pick-up roller and the depressive device. When the driving device drives the depressive device to press down on the front end of the lift plate so that the paper on the lift plate is moved away from the pick-up roller, the lift plate will press the separator and cause the separator to move away from the pick-up roller. The paper blocking mechanism will push the paper backwards to the lift plate, and when the driving device drives the depressive device in the opposite direction, the first elastic device will lift up the front end of the lift plate so that the uppermost sheet of paper on the lift plate contacts the pick-up roller, and the separator will contact the pick-up roller due to the motion of the lift plate. The paper blocking mechanism is pushed away at the same time so that the paper on the lift plate can be moved forwards and leave the lift plate.

It is an advantage of the present invention that the paper separator and paper blocking mechanisms ensure that the automatic paper feeding system delivers only a single sheet of paper at a time.

These and other objectives and advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 1:
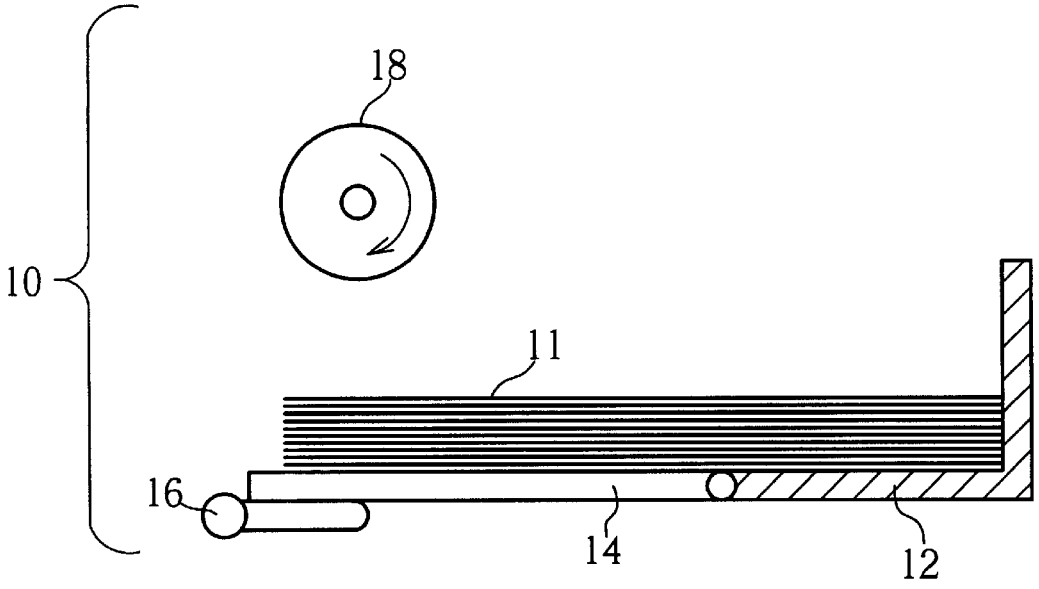
Fig.1 Prior art
FIG. 1 is a schematic view of a conventional paper feeding system.
Figure 2:
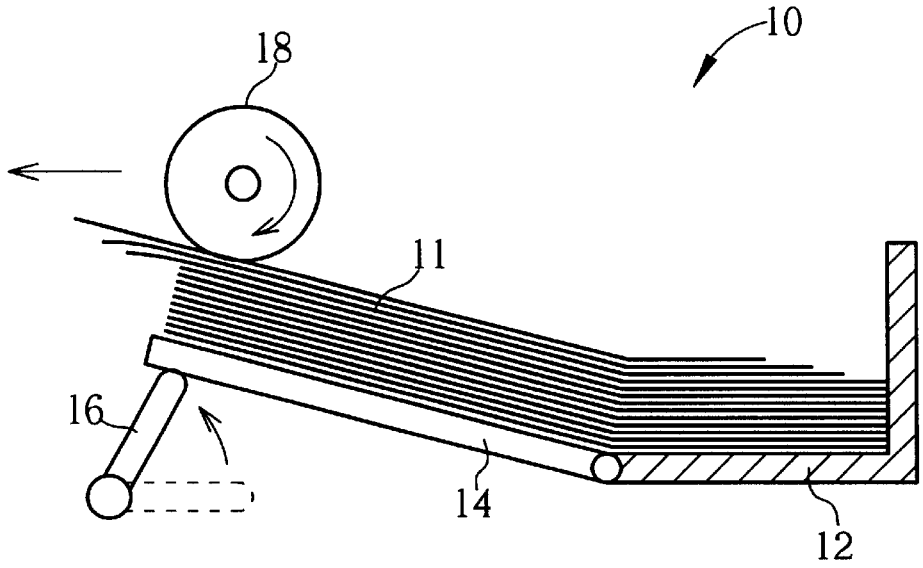
Fig.2 Prior art
FIG. 2 shows a situation when the conventional paper feeding system in FIG. 1 sends out multiple sheets of paper.
Figure 3:
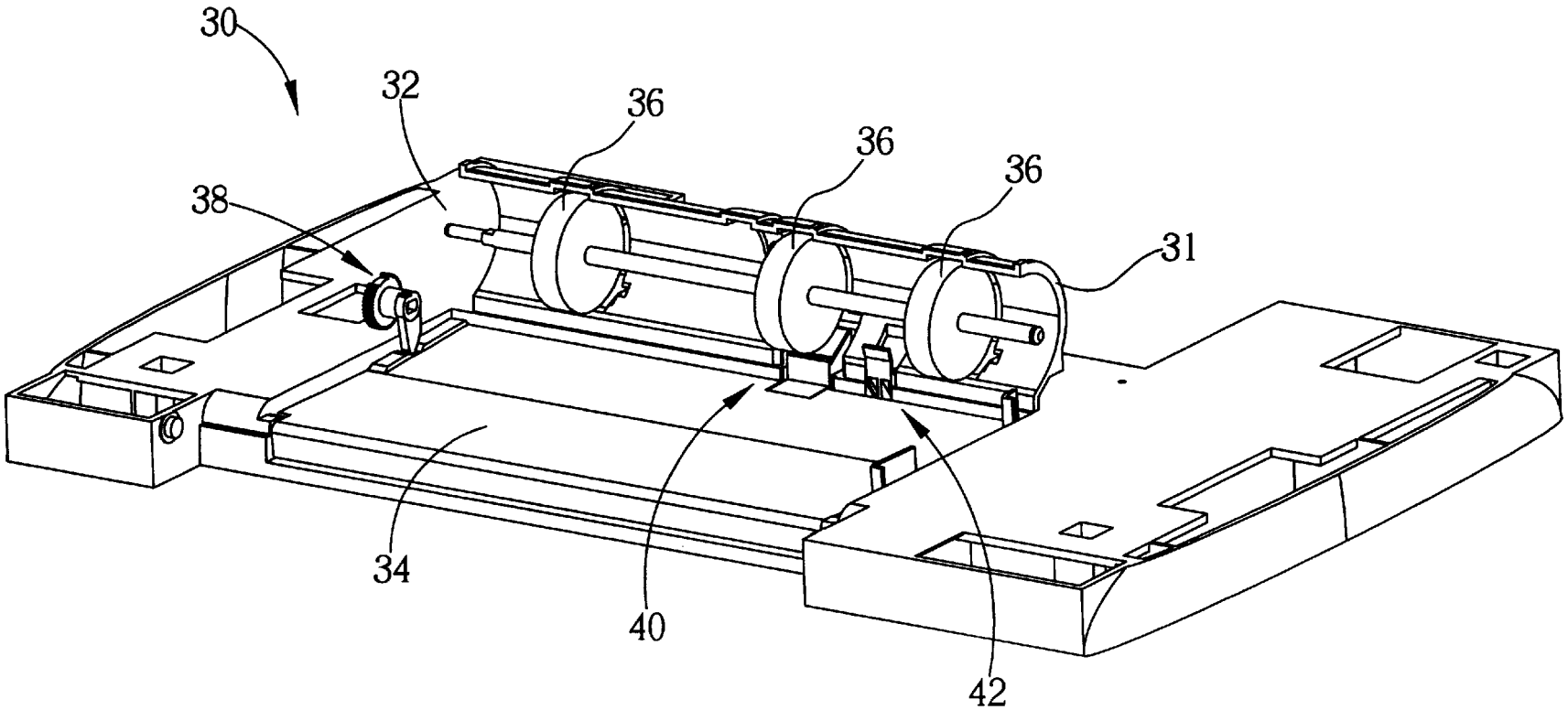
FIG. 3 is a schematic view of a paper feeding system with separator and paper blocking mechanisms according to the present invention.

Please refer to FIG. 3, which is a schematic view of a paper feeding system 30 with a separator and a paper blocking mechanism according to the present invention. The paper feeding system 30 comprises a housing 32, a lift plate 34 in the housing 32 for holding paper, a pick-up roller 36 rotatably provided in the housing 32 above the front end of the lift plate 34, an idle roller 35 (shown in FIGS. 6*a*–7*b*) rotating with the pick-up roller 36, a first elastic device 46 (shown in FIGS. 6*a*–7*b*) in the housing 32 and is located under and contacting the front end of the lift plate 34 for raising the front end of the lift plate 34, a depressive device 38, a separator 40, a blocking mechanism 42, and a driving device 60 (shown in FIGS. 6*a*, 7*a*). A paper guide plate 31 is provided corresponding to the pick-up roller 36, and the space between the paper guide plate 31 and the pick-up roller 36 forms a paper passageway. The paper guide plate 31 is mounted around the rim of the pick-up roller 36 for guiding and sending paper out of the paper feeding system 30 through the paper passageway. The lift plate 34 comprises a front end and a rear end, with the rear end rotatably fixed within the housing 32. When the first elastic device 46 raises the front end of the lift plate 34, the uppermost sheet of paper on the lift plate 34 will contact the pick-up roller 36, which, due to rotation, sends the uppermost sheet of paper on the lift plate 34 out of the paper feeding system 30. The depressive device 38 pushes the front end of the lift plate 34 downwards so that paper on the lift plate 34 separates from the pick-up roller. The depressive device 38 can be a cam 37 that is rotatably installed on one side of the lift plate 34.

Figure 6A:
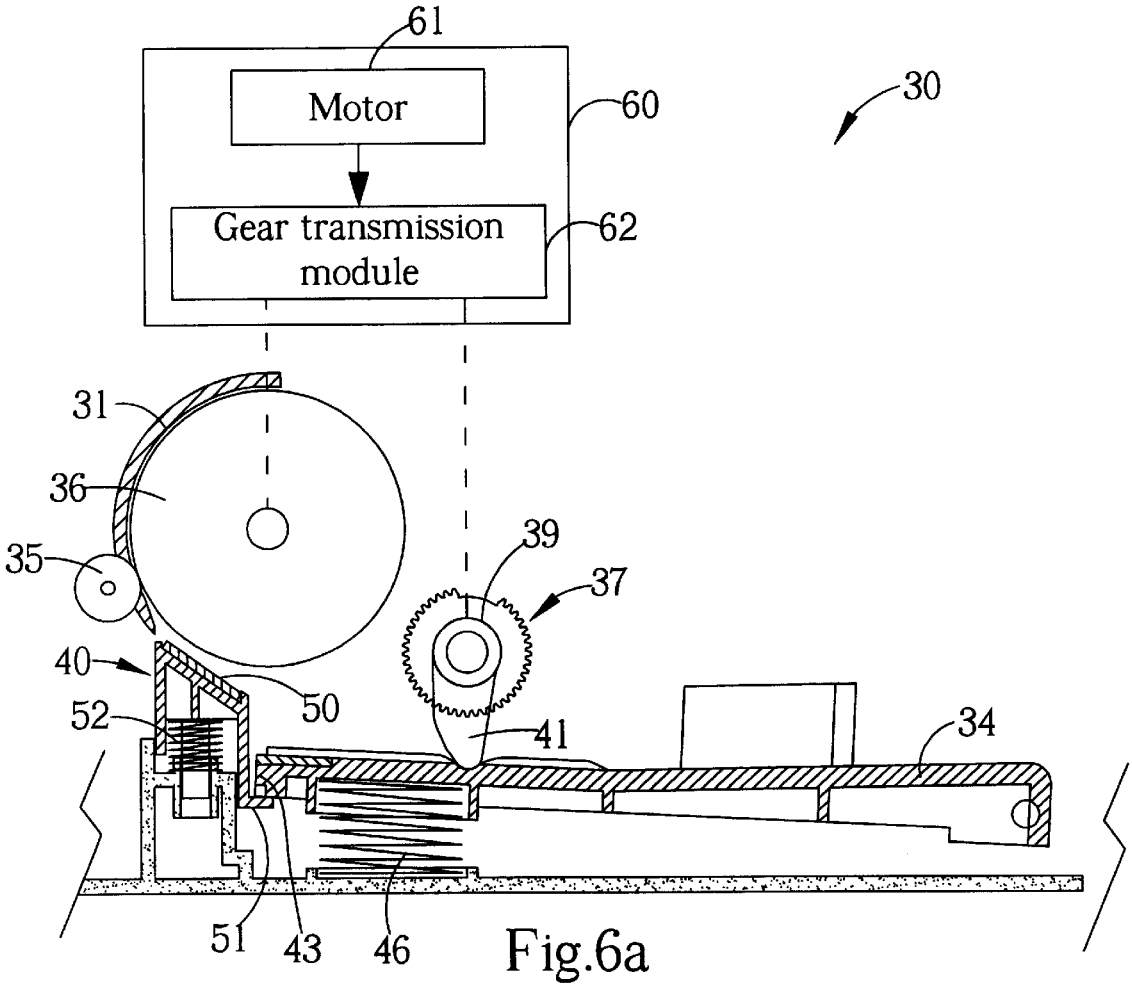
FIGS. 6*a* and 6*b* show schematic actions of the separator of the paper feeding system in FIG. 3.
Figure 6B:
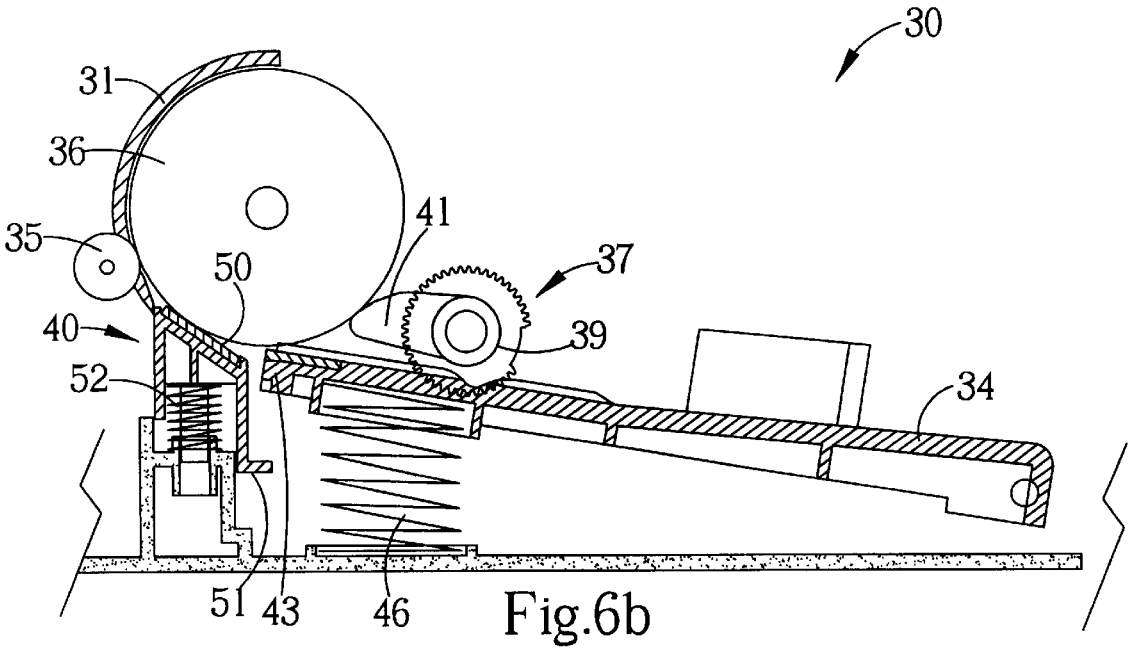

Referring to FIGS. 6*a* and 6*b,* when the driving device 60 drives the cam 37 to rotate such that the protruding portion 41 of the cam 37 contacts the lift plate 34, the protruding portion 41 pushes the front end of the lift plate 34 downwards. On the other hand, when the driving device 60 drives the cam 37 to rotate such that the rounded portion 39 of the cam 37 is instead contacting the lift plate 34, the uppermost paper on the lift plate 34 contacts the pick-up roller 36 because the first elastic device 46 pushes the front end of the lift plate 34 against the pick-up roller 36. The driving device 60 may comprise a motor 61 and a gear transmission module 62. The motor 61 drives the cam 37 and the pick-up roller 36 using the gear transmission module 62. In this preferred embodiment the first elastic device 46 is a spring, or other such elastic apparatus, installed under the front end of the lift plate 34 for pushing the front end of the lift plate 34 against the pick-up roller 36.

Figure 4:
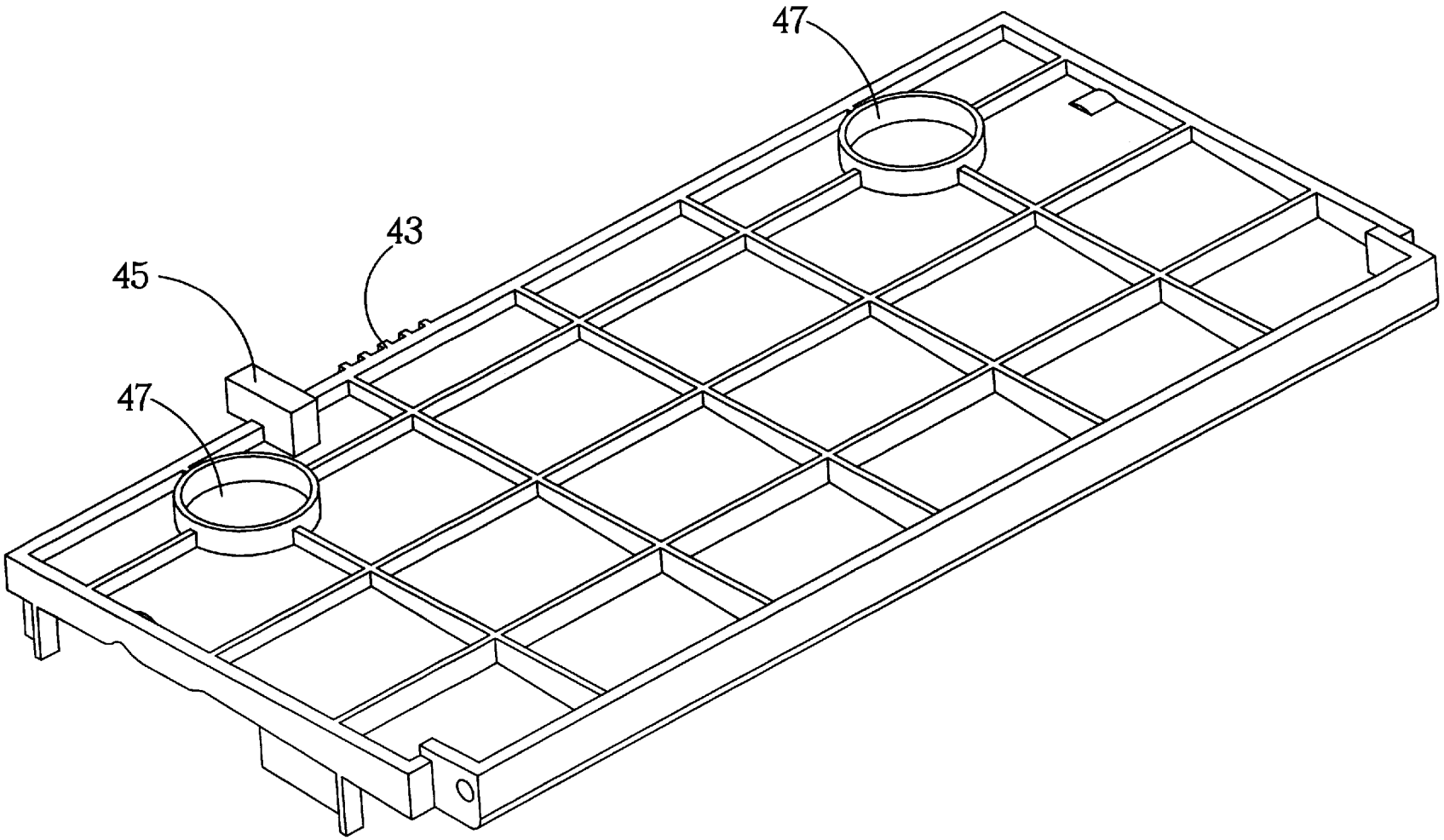
FIG. 4 is a schematic view of the bottom surface of a lift plate in the paper feeding system in FIG. 3.

Please refer to FIG. 4, which is a schematic view of the bottom surface of the lift plate 34 in the paper feeding system 30. As shown in the drawing, two round frames 47 are provided near the front end on the back of the lift plate 34 for accommodating the first elastic device 46. A protruding edge 43 is provided on the front end of the lift plate 34, and its position corresponds to the separator 40. Another protruding edge 45 is provided on the front end of the lift plate 34, and its position corresponds to the paper blocking mechanism 42. When the lift plate 34 is raised or is pushed down, the two protruding edges 43, 45 at the front end of the lift plate 34 will actuate the separator 40 and the paper blocking mechanism 42, respectively.

Figure 5A:
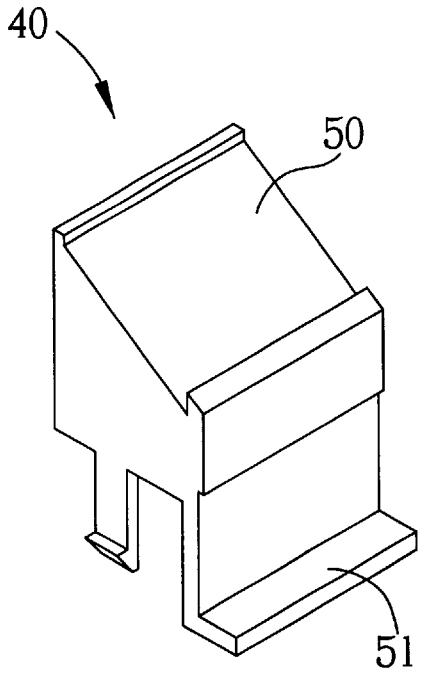
FIGS. 5*a* to 5*d* schematically show the separator and the paper blocking mechanism of the paper feeding system in FIG. 3.
Figure 5B:
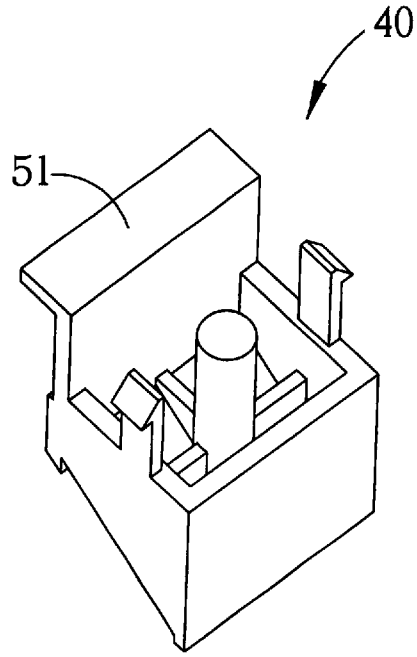
Figure 5C:
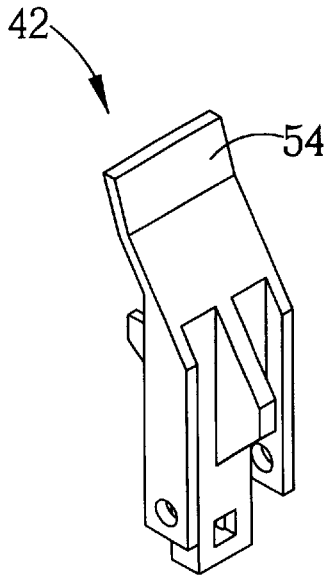
Figure 5D:
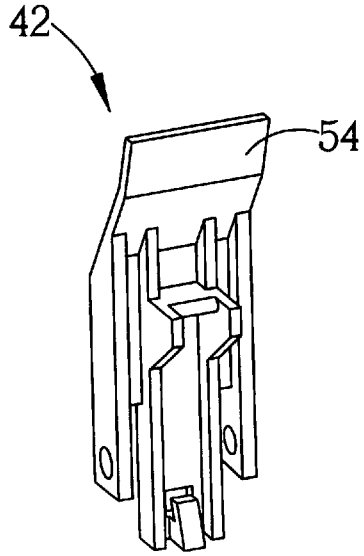

FIGS. 5*a* through 5*d* schematically show the separator 40 and paper blocking mechanisms 42 of the paper feeding system 30. FIG. 5*a* is a perspective view of the top of the separator 40. FIG. 5*b* is a perspective view of the bottom of the separator 40. FIG. 5*c* is a perspective view of the front of the paper blocking mechanism 42. FIG. 5*d* is a perspective view of the back of the paper blocking mechanism 42. The separator 40 comprises a clutch friction pad 50, a front edge 51 that fits the protruding edge 43 of the lift plate 34, and a second elastic device 52 (shown in FIGS. 6*a* and 6*b*) installed at the bottom of the clutch friction pad 50 for elastically raising the separator 40. Thus, when the front end of the lift plate 34 is depressed, its protruding edge 43 actuates the front edge 51 of the separator 40 so that the separator 40 is brought downwards to depress the second elastic device 52. When the front end of the lift plate 34 is lifted, the second elastic device 52 is released so that the clutch friction pad 50 is elastically pushed towards the pick-up roller 36. The second elastic device 52 can be a spring or other elastic devices.

The paper blocking mechanism 42 is installed ahead of the front end of the lift plate 34 for blocking the paper from moving forwards and leaving the lift plate 34. The paper blocking mechanism 42 comprises a baffle plate 54 rotatably installed in the housing 32, and a third elastic device 56 (FIGS. 7*a* and 7*b*) in the housing 32 for elastically pushing the baffle plate 54 towards the front end of the lift plate 34. When the lift plate 34 moves downwards, the baffle plate 54 is elastically pushed towards the front end of the lift plate 34 by the third elastic device 56 so that sheets exiting the front end of the lift plate 34 are pushed backwards to the lift plate 34. When the lift plate 34 moves upward, the protruding edge 45 at the front end of the lift plate 34 will push the baffle plate 54 away. Paper on the lift plate 34 can thus be pushed forwards by the pick-up roller 36 and leave the lift plate 34 without being blocked by the baffle plate 54 of the paper blocking mechanism 42. In the present embodiment, the third elastic device 56 is a torsion spring, a coiled spring, or other elastic devices.

Please refer to FIGS. 6*a* and 6*b,* which show schematic actions of the separator 40 of the paper feeding system 30. FIG. 6*b* schematically shows that the protrusion portion 41 of the cam 37 pushes down on both the lift plate 34 and the separator 40 simultaneously. FIG. 6*b* schematically shows that the first elastic device 46 raises both the lift plate 34 and the separator 40 simultaneously. When the paper feeding system 30 begins to feed paper, the driving device 60 operates in the forward direction, and the cam 37 rotates. When the rounded portion 39 of the cam 37 rotates to contact the lift plate 34, the first elastic device 46 will lift up the front end of the lift plate 34. The separator 40 is then lifted up by the second elastic device because the front protruding edge 43 of the lift plate 34 does not depress the front edge 51 of the separator 40. If the pick-up roller 36 simultaneously moves two sheets of paper out of the lift plate 34, the pick-up roller 36 will rotate the idle roller 35 and move the upper sheet further forward, whereas the separator 40 stops the lower sheet. Since friction between the pick-up roller 36 and paper, and between the clutch friction pad 50 and the paper are greater than the friction between the sheets of paper, the pick-up roller 36 can readily move away the sheet it contacts, with the rest of the paper remaining on the clutch friction pad 50. When the desired sheet moves out of the paper feeding system 30, the driving device 60 starts to operate in the reverse direction so that the protruding portion 41 of the cam 37 rotates to contact the lift plate 34. The protruding portion 41 of the cam 37 depresses the front end of the lift plate 34 downwards, and simultaneously the protruding edge 43 at the front end of the lift plate 34 pushes the separator 40 downwards to separate it from the pick-up roller 36.

Figure 7A:
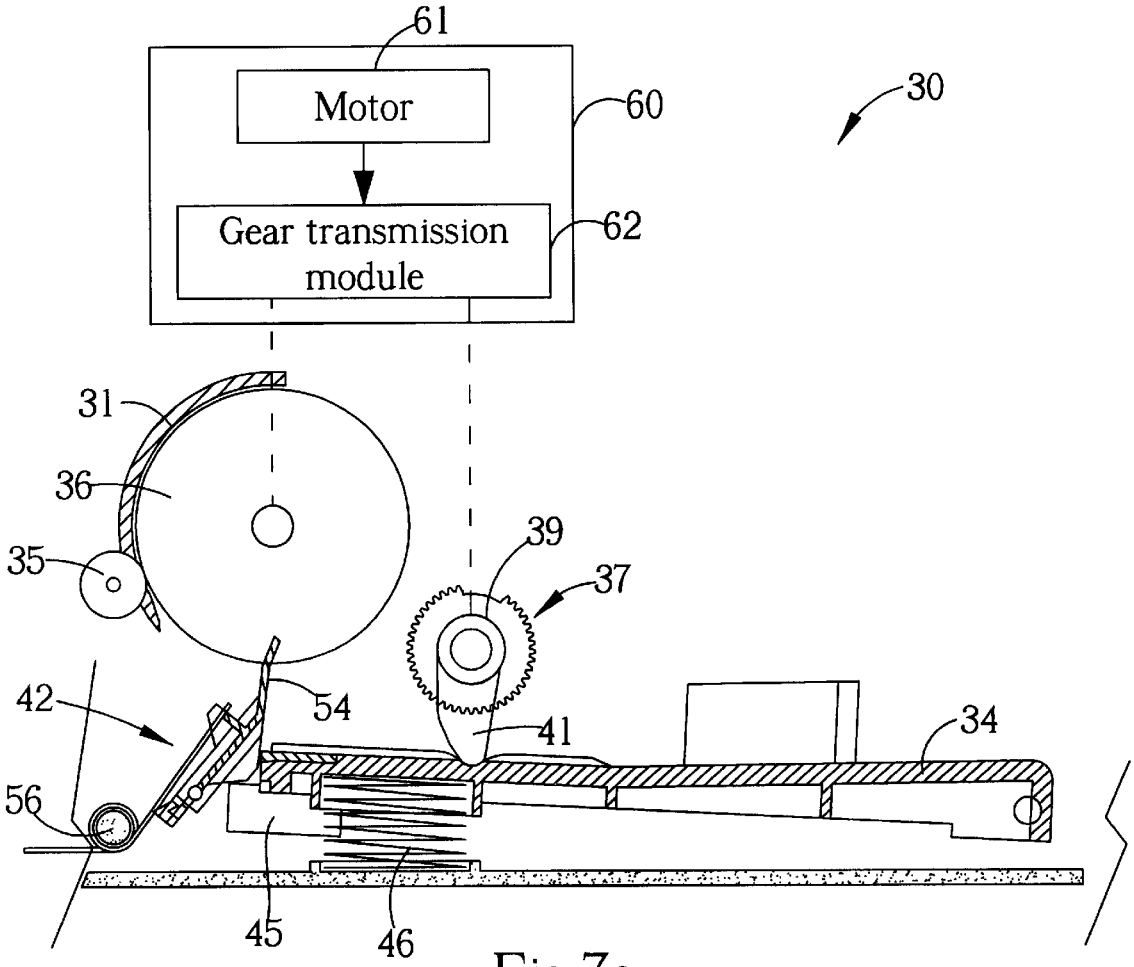
FIGS. 7*a* and 7*b* show schematic actions of the paper blocking mechanism of the paper feeding system in FIG. 3.
Figure 7B:
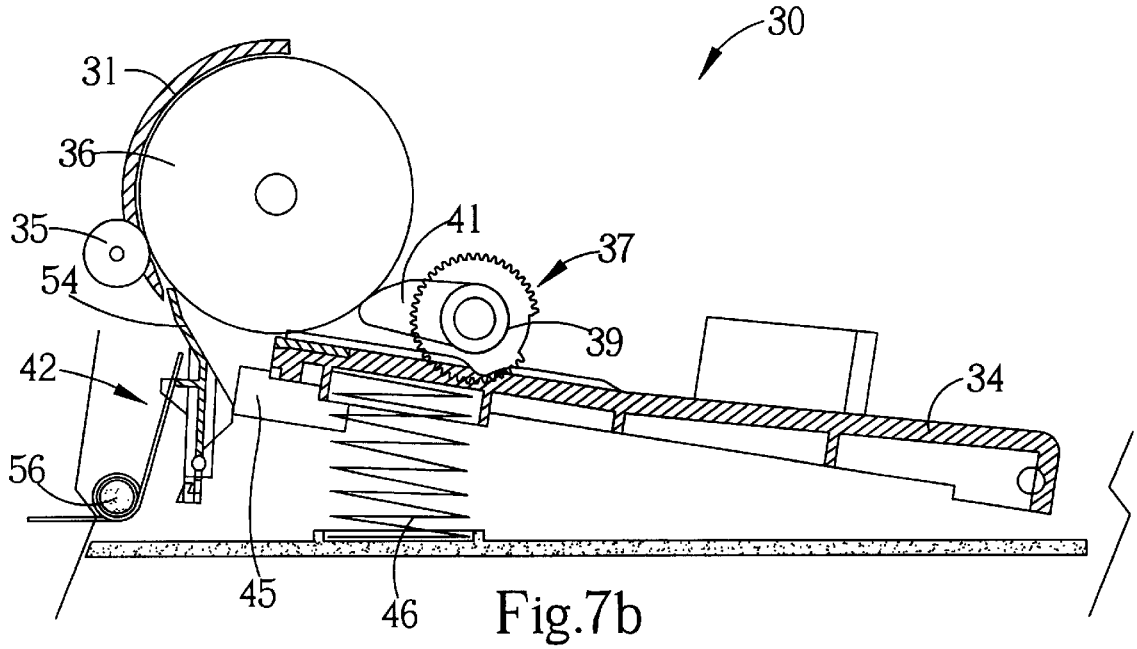

Please refer to FIGS. 7*a* and 7*b,* which show schematic actions of the paper blocking mechanism 42 of the paper feeding system 30. FIG. 7*a* is a schematic view showing that the protruding portion 41 of the cam 37 pushes both the lift plate 34 and the paper blocking mechanism 42 downwards simultaneously. FIG. 7*b* is a schematic view showing that the first elastic device 46 lifts both the lift plate 34 and the paper blocking mechanism 42 upwards simultaneously. When the paper feeding system 30 begins to feed paper, the driving device 60 operates in the forward direction, and the cam 37 rotates. When the rounded portion 39 of the cam 37 rotates to contact the lift plate 34, the first elastic device 46 will lift up the front end of the lift plate 34 and, at the same time, the protruding edge 45 of the lift plate 34 pushes the paper blocking mechanism 42 away. Paper on the lift plate 34 can thus be moved out of the lift plate 34 by the pick-up roller 36. When a sheet moves out of the paper feeding system 30, the driving device 60 starts to operate in the reverse direction to drive the cam 37 so that the protruding portion 41 of the cam 37 rotates to contact the lift plate 34. The protruding portion 41 of the cam 37 depresses the front end of the lift plate 34 downwards, and simultaneously the protruding edge 45. The baffle plate 54 of the paper blocking mechanism 42 is pushed to the front end of the lift plate 34 by the third elastic device 56 so that paper passing the front end of the lift plate 34 are moved backwards to the lift plate 34 and aligned with the edge of the lift plate 34. Therefore, the paper left by the separator 40 is pushed back to the lift plate 34 to effectively prevent paper damage or improper feeding.

Compared to conventional paper feeding systems, the paper feeding system 30 includes the separator 40 and the paper blocking mechanism 42, using the two protruding edges 43, 45 at the front end of the lift plate 34 to simultaneously control the actions of the separator 40 and the paper blocking mechanism 42. The separator 40 guarantees that the paper feeding system 30 sends out one sheet of paper at a time to prevent waste of paper and paper jamming due to multiple paper feeding. The paper blocking mechanism 42 pushes paper sheets left by the separator 40 back to the lift plate 34 so that the sheets will not be folded or torn while the lift plate 34 moves downwards and aligns with the edge of the lift plate 34. Thus, the paper feeding system 30 can send out one undamaged sheet of paper at a time for document processing.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A paper feeding system comprising:

a lift plate for holding paper;

a first elastic device for lifting up the lift plate;

a pick-up roller arranged above the lift plate, wherein when the first elastic device lifts up the lift plate, the pick-up roller frictionally engages an uppermost sheet of the paper;

a depressive device for selectively pressing down the lift plate against the first elastic device; and a paper blocking mechanism installed ahead of a front end of the lift plate;

wherein when the lift plate is pressed down, the paper blocking mechanism moves within the circumferential plane of the pick-up roller, and when the lift plate is lifted up, the lift plate pushes the paper blocking mechanism away from the pick-up roller.

2. The paper feeding system of claim 1 wherein the depressive device is a cam that is rotatably installed on one end of the lift plate, the cam comprising a rounded portion and a protruding portion, wherein when the protruding portion of the cam contacts the lift plate, the protruding portion will push the front end of the lift plate downwards, and when the protruding portion of the cam moves away from the lift plate, the first elastic device will lift the front end of the lift plate to contact the rounded portion of the cam.

3. The paper feeding system of claim 2 wherein the paper feeding system further comprises a driving device comprising a motor and the cam, the driving the pick-up roller and a gear transmission module, and the motor drives the cam and the pick-up roller via the gear transmission module.

4. The paper feeding system of claim 1 wherein the rear end of the lift plate is rotatably fixed in a housing of the paper feeding system.

5. The paper feeding system of claim 1 wherein the first elastic device is a spring installed below the lift plate, and the spring is used to lift a front end of the lift plate.

6. The paper feeding system of claim 1 further comprising a separator capable of contacting the pick-up roller, wherein when the separator contacts the pick-up roller and the pick-up roller moves two sheets of the paper from the lift plate, the pick-up roller will continue to move the upper sheet and the separator will stop the lower sheet from moving, wherein the separator comprises a clutch friction pad, and a second elastic device installed below the clutch friction pad, the second elastic device lifting the clutch friction pad towards the pick-up roller, wherein when a front end of the lift plate moves downward, the clutch friction pad will move away from the pick-up roller, and when the front end of the lift plate moves upward, the clutch friction pad will be pushed towards the pick-up roller.

7. The paper feeding system of claim 1 wherein the paper blocking mechanism is rotatably installed in the housing, and when the front end of the lift plate moves downward, the paper blocking mechanism will push the paper backwards to the lift plate, and when the front end of the lift plate moves upwards, the front end of the lift plate will push the paper blocking mechanism away so that the paper can move forward and leave the lift plate.

8. The paper feeding system of claim 7 wherein the paper blocking mechanism comprises a baffle plate rotatably installed in the housing, and a third elastic device installed in the housing, the third elastic device being used to push the baffle plate towards the front end of the lift plate, wherein when the lift plate moves downward, the baffle plate is pushed to the front end of the life plate so that the paper moves back to the lift plate, and when the lift plate moves upward, the front end of the lift plate will push the baffle plate away so that the paper can move forward and leave the lift plate.

9. A paper feeding system comprising:

a lift plate for holding paper;

a first elastic device for lifting up a front end of he lift plate;

a pick-up roller arranged above the front end of the lift plate, wherein when the first elastic device lifts up the front end of the lift plate, the pick-up roller frictionally engages an uppermost sheet of the paper;

a depressive device for selectively pressing down on the front end of the lift plate against the first elastic device; and a paper blocking mechanism installed ahead of the front end of the lift plate and capable of blocking the paper from moving forward and leaving the lift plate;

wherein when the depressive device presses down on the front end of the lift plate, the lift plate will activate the paper blocking mechanism to push the paper backwards to the lift plate, and when the lift plate is lifted up, the lift plate pushes the paper blocking mechanism away from the circumferential plane of the pick-up roller.

10. The paper feeding system of claim 9 further comprising a separator capable of contacting the pick-up roller, wherein when the separator contacts the pick-up roller and the pick-up roller moves two sheets of the paper from the lift plate, the pick-up roller will continue to move the upper sheet of the paper and the separator will stop the lower sheet of the paper from moving.

11. The paper feeding system of claim 10 wherein when the depressive device presses the front end of the lift plate downwards so that the paper in the lift plate is moved away from the pick-up roller, the lift plate presses the separator and causes the separator to move away from the pick-up roller, and when the depressive device releases the front end of the lift plate, the first elastic device lifts up the lift plate so that an uppermost sheet of the paper in the lift plate contacts the pick-up roller, and the separator contacts the pick-up roller due to the motion of the lift plate.

12. The paper feeding system of claim 11 wherein the separator comprises a clutch friction pad and a second elastic device, the second elastic device installed below the clutch friction pad for pushing the clutch friction pad towards the pick up roller, wherein when the front end of the lift plate moves downwards, the clutch friction pad moves away from the pick-up roller, and when the front end of the lift plate moves upward, the clutch friction pad moves towards the pick up roller.

13. The paper feeding system of claim 9 wherein a rear end of the lift plate is rotatably fixed in a housing of the paper feeding system.

14. The paper feeding system of claim 9 wherein the depressive device is a cam rotatably installed on one end of the lift plate, the cam comprising a rounded portion and a protruding portion, wherein when the protruding portion of the cam contacts the lift plate, the protruding portion will push the front end of the lift plate downwards, and when the protruding portion of the cam moves away from the lift plate, the first elastic device will lift the front end of the lift plate to contact the rounded portion of the cam.

15. The paper feeding system of claim 14 wherein the paper feeding system further comprises a driving device, and the driving device comprises a motor and a gear transmission module, the motor driving the cam and the pick-up roller via the gear transmission module.

16. The paper feeding system of claim 9 wherein the first elastic device is a spring installed below the front end of the lift plate, and the spring is used to lift the front end of the lift plate.

17. The paper feeding system of claim 9 wherein the paper blocking mechanism comprises a baffle plate and a third elastic device, the third elastic device being used to push the baffle plate towards the front end of the lift plate, wherein when the lift plate moves downward, the baffle plate is pushed to the front end of the life plate so that the paper moves backwards to the lift plate, and when the lift plate moves upwards, the front end of the lift plate will push the baffle plate away so that the paper can move forward and leave the lift plate.

* * * * *